US005672022A

United States Patent [19]

Lin

[11] Patent Number: 5,672,022

[45] Date of Patent: Sep. 30, 1997

[54] BINDER FOR LOOSE-LEAF NOTEBOOK

[76] Inventor: Yu Chia Lin, 5th Fl., No.1, Lane 193, Chung Cheng N. Rd., Sanchung City, Taipei Hsien, Taiwan

[21] Appl. No.: 714,280

[22] Filed: Sep. 17, 1996

[51] Int. Cl.[6] ..... B42F 13/00

[52] U.S. Cl. ..... 402/73; 402/77; 402/7.7; 281/29

[58] Field of Search ..... 402/70, 73, 74, 402/76, 77; 281/19.1, 21.1, 29, 36, 37

[56] References Cited

U.S. PATENT DOCUMENTS 3,046,932 7/1962 Rodrigue ..... 281/29 X
4,828,421 5/1989 Arakaki ..... 281/29 X
5,108,212 4/1992 Lee ..... 402/76 X
5,273,319 12/1993 Lee ..... 281/19.1 X

*Primary Examiner*—Willmon Fridie, Jr.
*Attorney, Agent, or Firm*—Bacon & Thomas

[57] ABSTRACT

Disclosed is a binder for loose-leaf notebook mainly including a hollow middle connector having two side axes and a label recess formed at a ridge portion thereof, two loose covers, two pivotal connectors having axis grooves and loose cover grooves to respectively engage with the side axes of the middle connector and two inner edges of two loose covers, two end insertions inserted into two end openings of the hollow middle connector, and two closing members disposed between the two loose covers. The binder can be easily produced and assembled to form a loose-leaf notebook while the loose covers thereof can be locked up.

14 Claims, 7 Drawing Sheets

321
32
3
71
7
5
4
2
1
31

3

323'
322'
32
22
21
11
41
402
401
4
40
5
61
6

BINDER FOR LOOSE-LEAF NOTEBOOK

BACKGROUND OF THE INVENTION

1. Field of the Invention

The present invention relates to a binder for loose-leaf notebook, and more particularly to a binder for loose-leaf notebook which is single in structure and convenient for production and assembling, and provides better appearance and reliable binding.

2. Description of the Prior Art

FIG. 1 illustrates a conventional binder for loose-leaf notebook. The binder mainly includes a middle connector 81 formed from an extruded hollow strip and two loose covers 83. The middle connector 81 has two end openings 811 to each receive an end insertion 82 therein. The end insertion 82 each includes a connecting portion 821 for inserting into the end opening 811 of the middle connector 81 and two pins 822 located at two lateral sides of the connecting portion 821. The loose cover 83 each is formed at two outer ends of an inner longitudinal edge with two holes 831 to receive the pins 822 of the end insertions 82 at the side adjacent to the loose cover 83. To assemble the middle connector 81 and the loose covers 83, first insert the pins 822 of the end insertions 82 at one side thereof into the corresponding holes 831 of the loose covers 83, and then insert the connecting portions 821 of the end connectors 82 into the end openings 811 of the middle connector 81. Fastening members 84 are used to secure the middle connector 81 and the end insertions 82 together, forming a binder for loose-leaf notebook.

Following disadvantages are found in the above-described conventional binder for loose-leaf notebook and require improvement:

1. The pins 822 of the end insertions 82 inserted into the holes 831 of the loose covers 83 tend to break when the loose-leaf notebook is carelessly collided with something and has been used for a long period, causing the loose covers 83 to disconnect from the middle connector 81.

2. The use of the fastening members 84 to secure the middle connector 81 with end insertions 82 causes complicated production and assembling of the loose-leaf notebook. Furthermore, when the loose covers 83 are turned to open the notebook, the pins 822 constantly frictionally contact with the holes 831 and tend to break or become rough and thinner, causing the loose covers 83 to unstably connect with the middle connector 81.

3. The two loose covers 83 can be easily opened from a closed condition. No locking means is provided to the binder.

It is therefore tried by the inventor to develop an improved binder for loose-leaf notebook to eliminate the above-mentioned disadvantages.

SUMMARY OF THE INVENTION

A primary object of the present invention is to provide a binder for loose-leaf notebook which has simple structure and the middle connector and the loose covers can be easily and quickly connected by means of sliding grooves without needing any other fastening and/or insertion means. The production and assembling costs of the binder can be largely reduced and the structure of the binder is more reliable.

Another object of the present invention is to provide a binder for loose-leaf notebook in which the middle connector and the loose covers are pivotally connected together by strong and active connecting means without easily becoming loose or swaying relative to the middle connector. The binder can therefore be used for longer period in a more practical manner.

A further object of the present invention is to provide a binder for loose-leaf notebook in which a closing member and a locking member are removably located in the end insertions of the binder to move along guiding grooves provided on edges of the loose covers when the loose covers are closed, so that the closing member and the locking member can meet with each other on the guiding grooves to lock up the closed loose covers.

The detailed structure, the applied principles, and the function of the present invention can be best understood from the following detailed description of the preferred embodiment and the accompanying drawings wherein:

Figures 2, 2A, 2B:
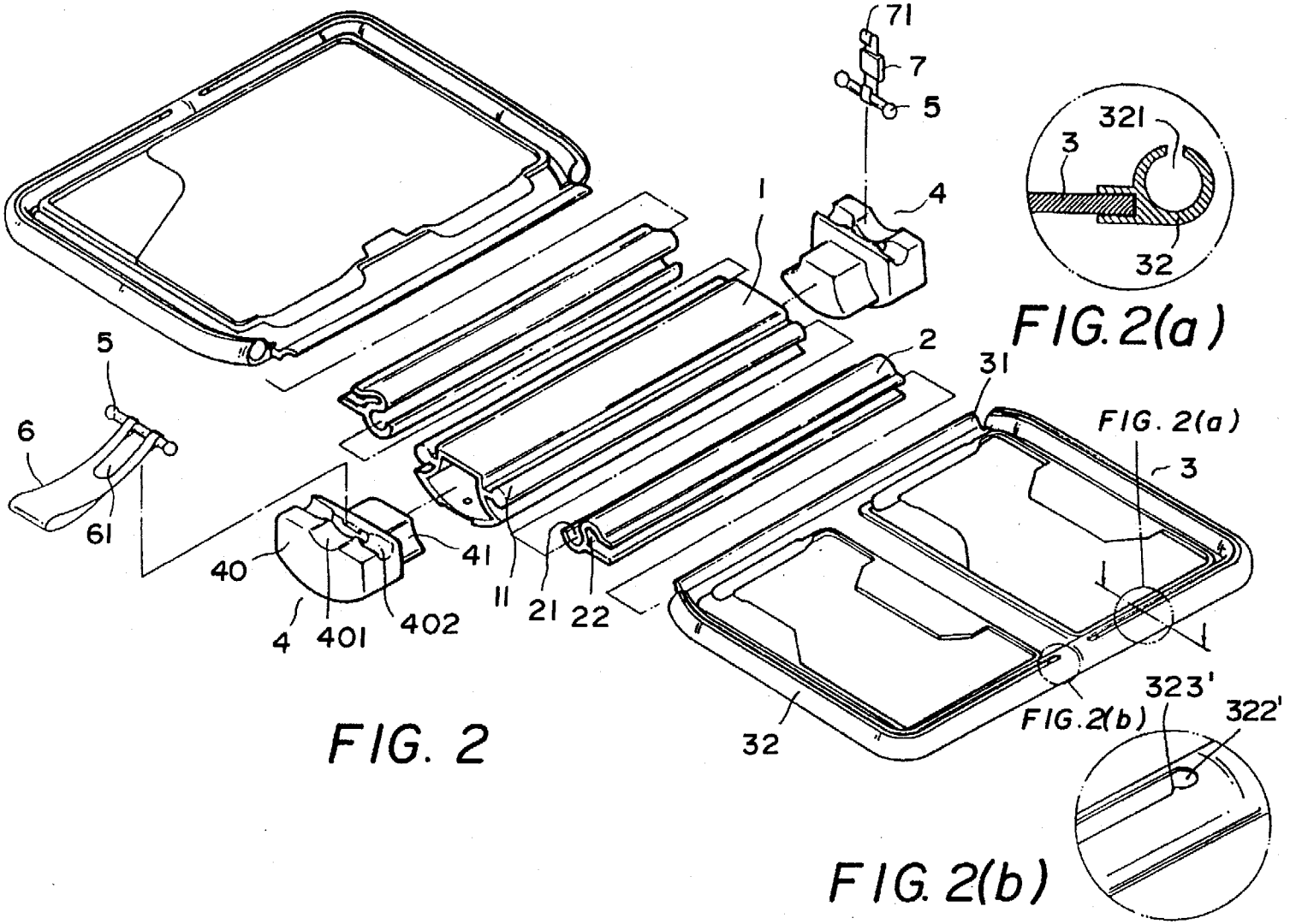
FIG. 2 is an exploded perspective of a binder for loose-leaf notebook according to the present invention.
Figure 3:
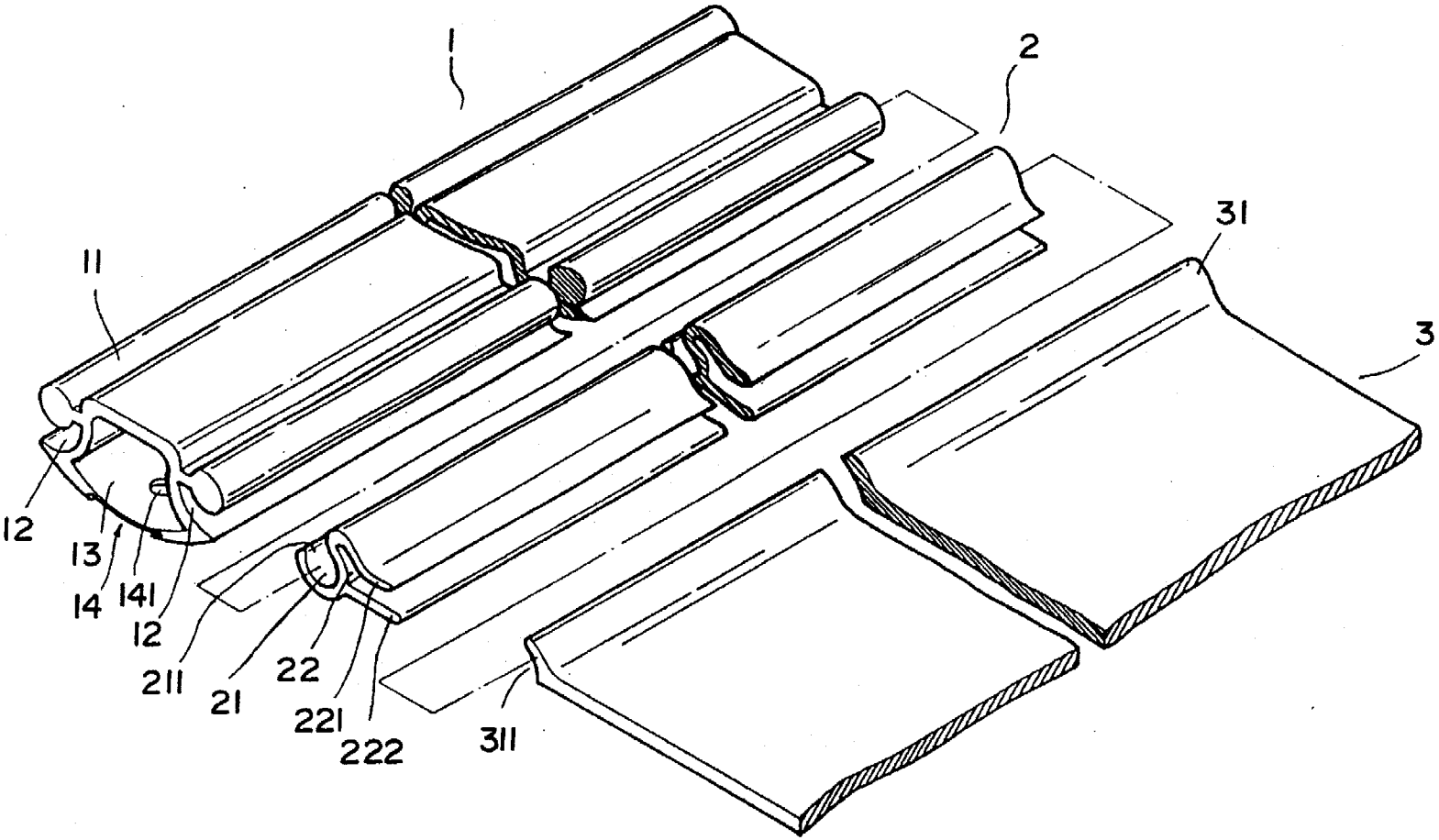
Figure 4:
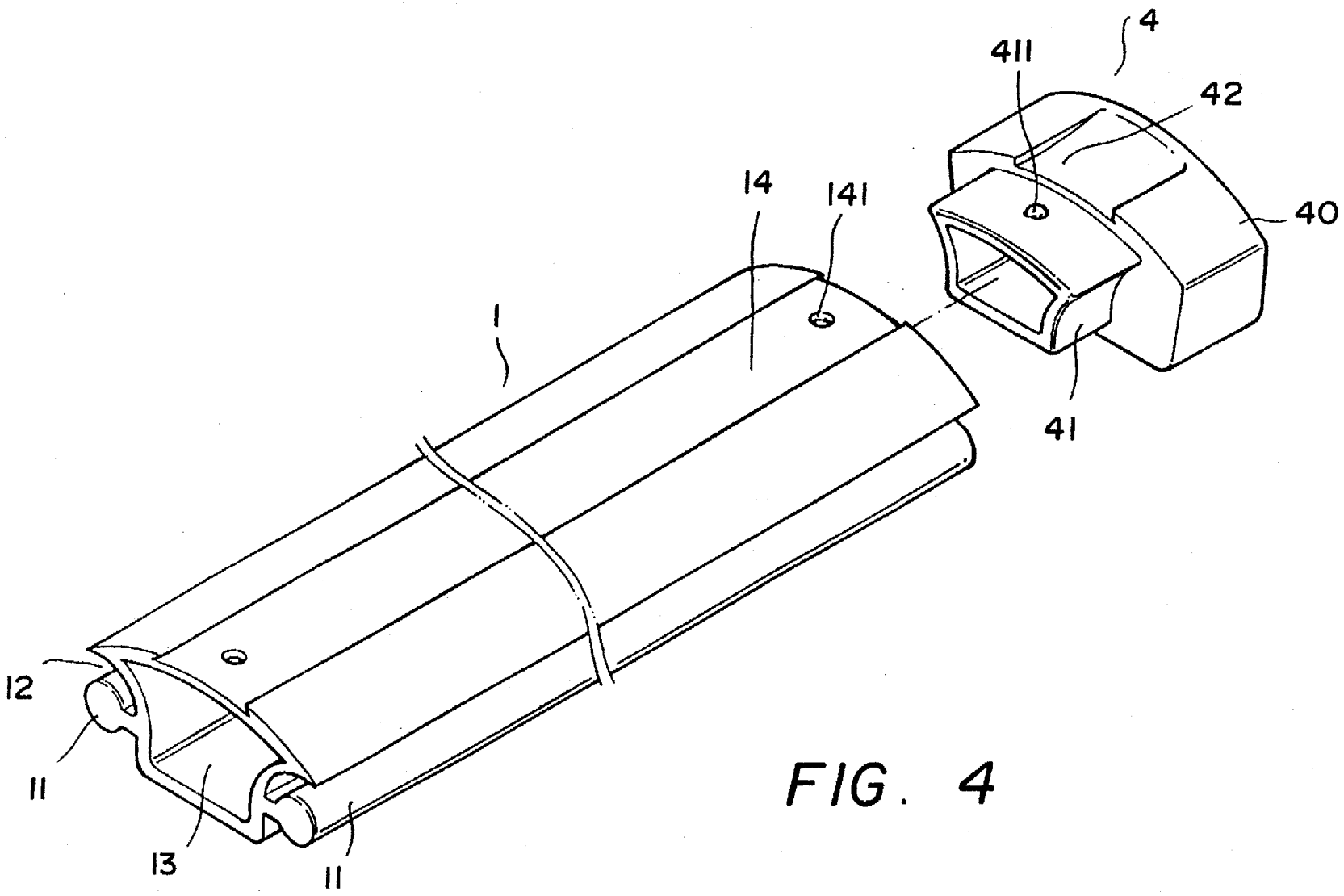
Figure 5:
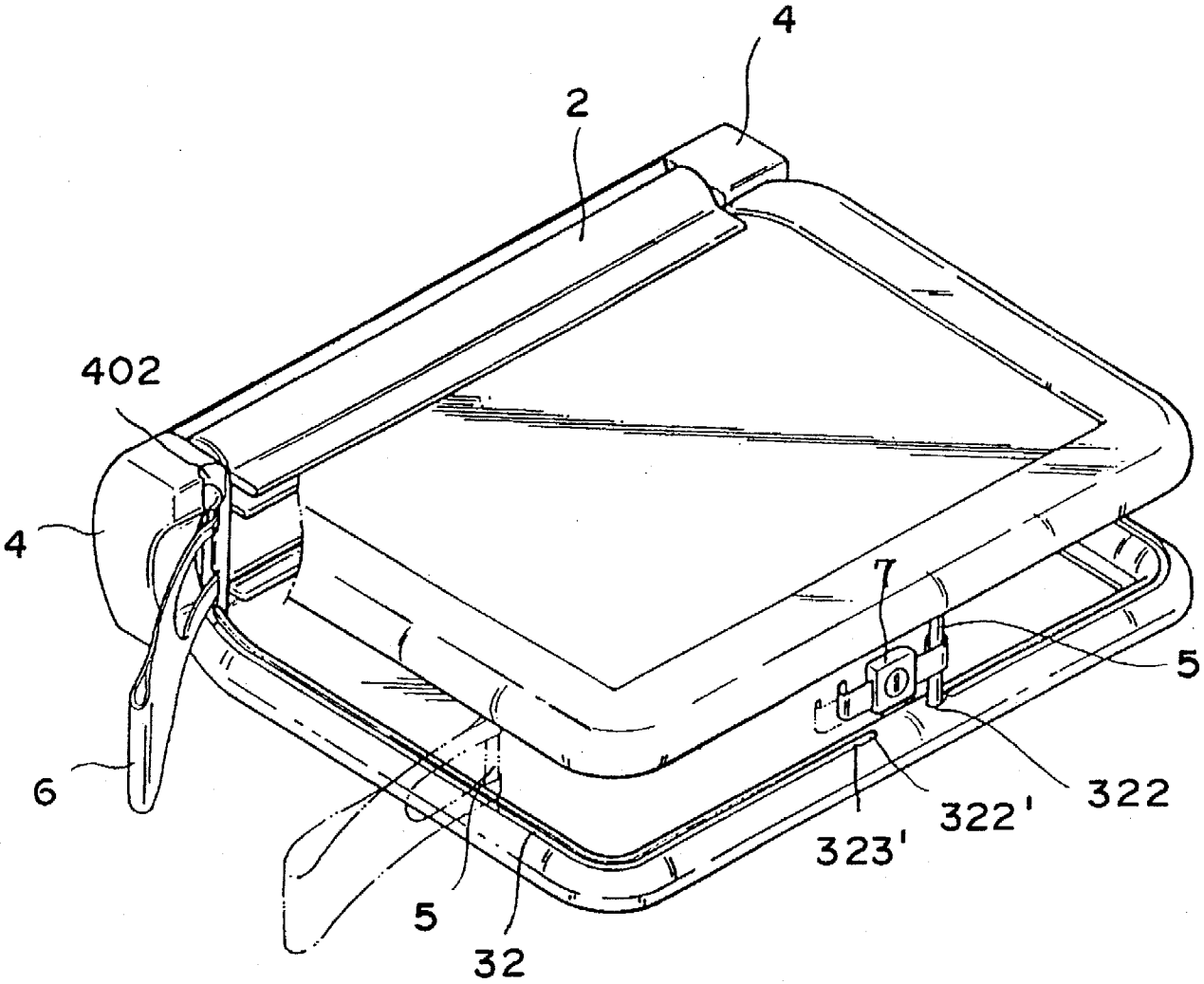
Figure 7:
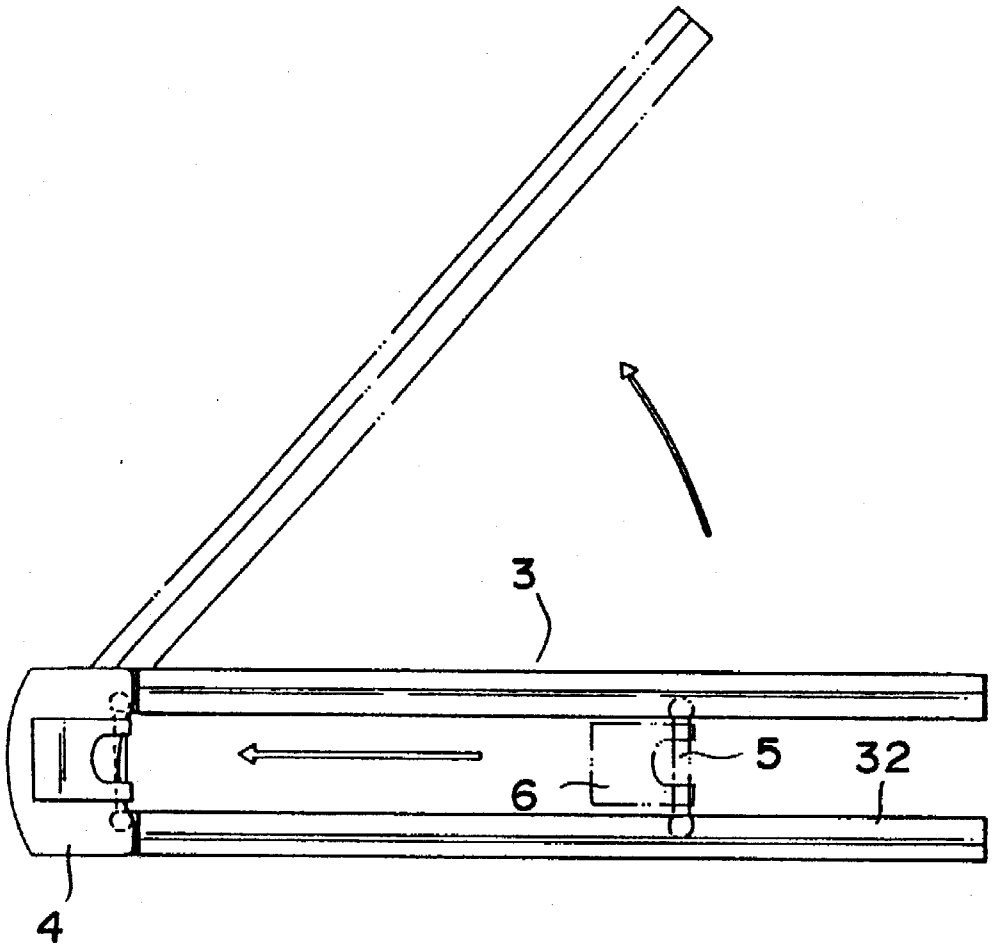

FIGS. **2*a*–2*b*** is a fragmentary, enlarged, sectional view showing the structure of the guiding rail adopted in the present invention;

FIG. 3 is an exploded perspective showing the main structure of the binder as shown in FIG. 2;

FIG. 4 is an exploded perspective showing the relation between the middle connector and the end insertion of the present invention;

FIG. 5 is a perspective showing the appearance of the binder according to the present invention in a closed and locked state;

FIGS. **6*a* and 6*b* illustrate the manner in which the loose covers of the binder of the present invention are closed and locked; and FIG. 7** illustrates the manner in which the closed loose covers of the binder are unlocked and opened.

DETAILED DESCRIPTION OF THE PREFERRED EMBODIMENTS

Please refer to FIGS. 2 and 3. The present invention relates to a binder for loose-leaf notebook. The binder mainly includes a middle connector 1, two pivotal connectors 2, two loose covers 3, two end insertions 4, two closing members 5, a pull member 6, and a locking member 7.

The middle connector 1 is a hollow body defining a hollow portion 13 with the two end insertions 4 removably inserted in two end openings thereof. Two side axes 11 respectively project from each longitudinal side of the middle connector 1, forming two clearances 12 between the side axes 11 and side walls of the hollow middle connector 1.

The pivotal connector 2 each includes an upper portion 221 and a lower portion 222 together containing a curvy loose cover groove 22 therebetween for receiving an inner edge of the loose cover 3. Another longitudinal axis groove 21 is formed behind the curry loose cover groove 22 to correspond to the side axis 11 of the middle connector 1. The axis groove 21 has a longitudinal outer edge 211 forming a long opening between the outer edge 211 and the other portion of the axis groove 21. The axis groove 21 has a width slightly smaller than the diameter of the side axes 11.

The loose covers 3 form the covers of the loose-leaf notebook. The loose cover 3 each has an inward bent inner edge 31 corresponding to the curry loose cover groove 22.

A lower surface 311 of the inner edge 31 of the loose cover 3 has a curve corresponding to that of the loose cover groove 22 so that the loose cover 3 can be easily slidably inserted into the groove 22 and be pivotally held thereto. A guiding rail 32 extends around the other three edges of the loose cover 3. Please also refer to FIG. 2A at the same time. The guiding rail 32 each has two guiding grooves 321, 321' extending along the guiding rail 32. Retaining parts 323 and 323' are provided at two sides of a joint of the two guiding grooves 321, 321'. Retaining portions 322 and 322' are formed at the ends of the guiding grooves 321, 321' near their joint.

The end insertion 4 each has a head portion 40 and an insertion portion 41. The head portion 40 is formed at an inner surface with a first recess 402 transversely extending therethrough for receiving the closing member 5 therein and a second recess 401 axially extending through the first recess 402 for receiving the pull member 6 or the locking member 7 therein.

The closing member 5 each is a rod-like member having two slide-guiding ends 51.

The pull member 6 is an n-shaped member with its two projected leg portions forming two loops 61 for one of the closing members 5 to thread through.

The locking member 7 is fixed to another closing member 5 and has a front hook portion 71.

To assemble the binder of the present invention, first align one of the side axes 11 of the middle connector 1 with the axis groove 21 of one of the pivotal connectors 2, then engage the pivotal connector 2 with the middle connector 1 by permitting the side axis 11 sliding into and along the axis groove 21, such that the side axis 11 is pivotally connected to the axis groove 21 with the outer edge 211 of the axis groove 21 fitly inserted in the clearance 12 formed between the side axis 11 and the side wall of the hollow middle connector 1, allowing the pivotal connector 2 to turn about the side axis 11. In similar steps, one of the loose covers 3 is connected to the pivotal connector 2 by engaging the inner edge 31 of the loose cover 3 into the loose cover groove 22 of the pivotal connector 2 with the curvy lower surface 311 of the edge 31 fitly contacting with the groove 22. The other pivotal connector 2 and loose cover 3 are sequentially connected to the other side of the middle connector 1 in the same manner. Finally, the end insertions 4 with the closing members 5 lain in the first recess 402 and the pull member 6 and the locking member 7 separately located in the second recess 401 are separately inserted into two ends of the hollow portion 13 of the middle connector 1, completing a firmly assembled binder of which the two loose covers 3 can be locked up with the pull member 6 and the locking member 7.

Please now refer to FIGS. 2 and 4 at the same time. A dovetail-shaped label recess 14 can be formed at a ridge portion of the hollow portion 13 of the middle connector 1. And, an inward gradually deepened guiding recess 42 is formed on an outer surface of the head portion 40 of the end insertions 4 corresponding to the label recess 14. When the insertion portions 41 of the end insertions 4 are inserted into the two ends of the hollow portion 13 of the middle connector 1, the label recess 14 and the guiding recesses 42 together form a means for conveniently receiving any label therein. Retaining holes 141 are formed on the label recess 14 to engage with retaining bosses 411 formed on the insertion portions 41 of the end insertions 4, so that the end insertions 4 can be firmly and safely connected to the middle connector 1 without easily disengaging therefrom. The head portions 40 of the end insertions 4 have two lateral ends projected from two lateral sides of the middle connector 1 when the end insertions 4 are inserted into the hollow portion 13. The projected lateral ends of the head portions 40 properly stop the pivotal connectors 2 from slipping off the side axes 11 of the middle connector 1 and the loose covers 3 off the clearances 22 of the pivotal connectors 2. The above assembling can be easily completed to form a reliable and durable binder for loose-leaf notebook without the need of any other fastening members. The label recess 14 can be formed to have a larger depth so as to receive a pen therein.

Figure 1:
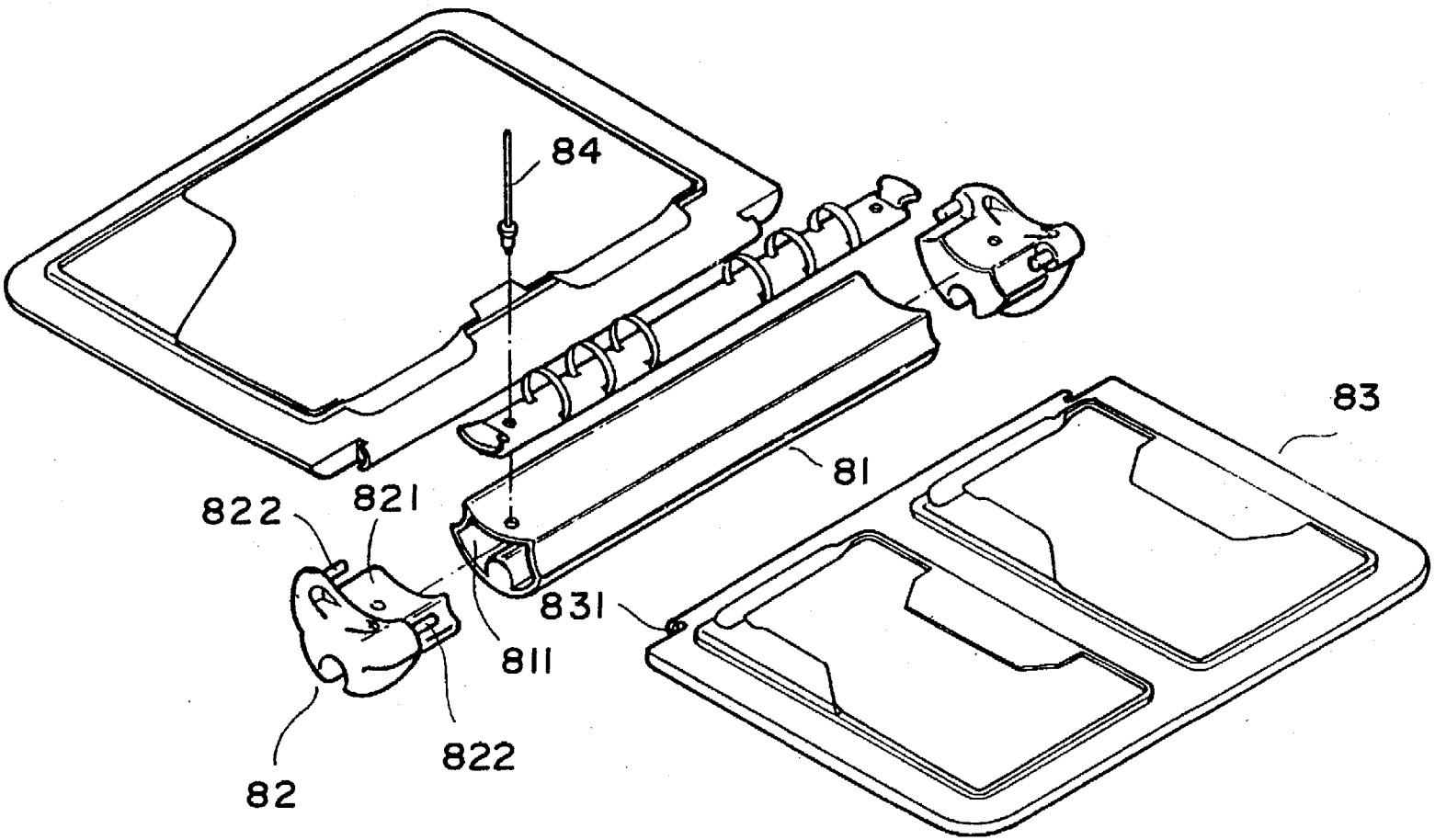
FIG. 1 PRIOR ART
FIG. 1 is an exploded perspective of a conventional binder for loose-leaf notebook.
Figure 6B:
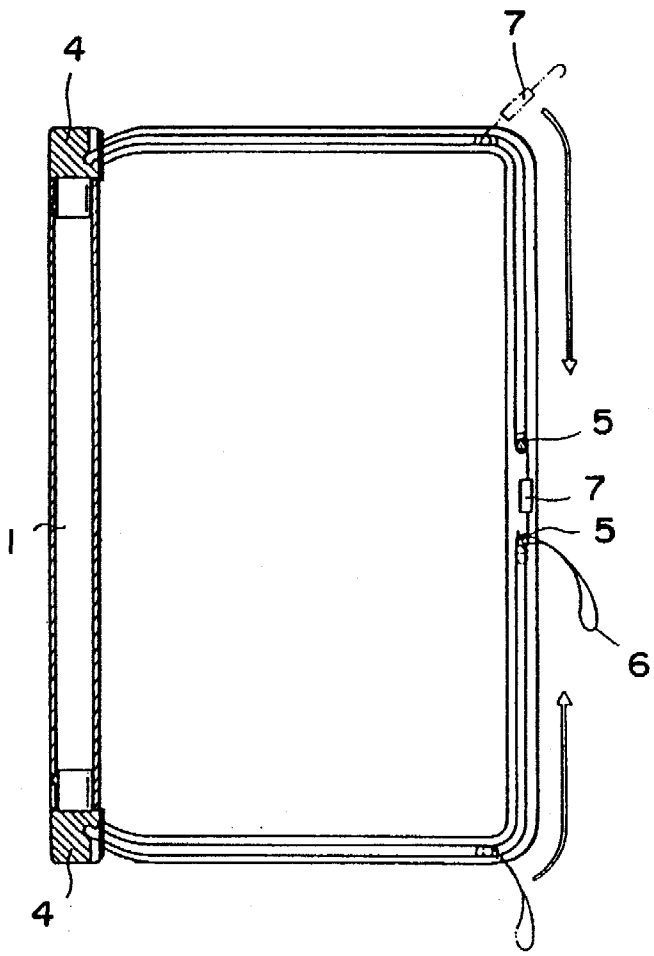
Figure 6A:
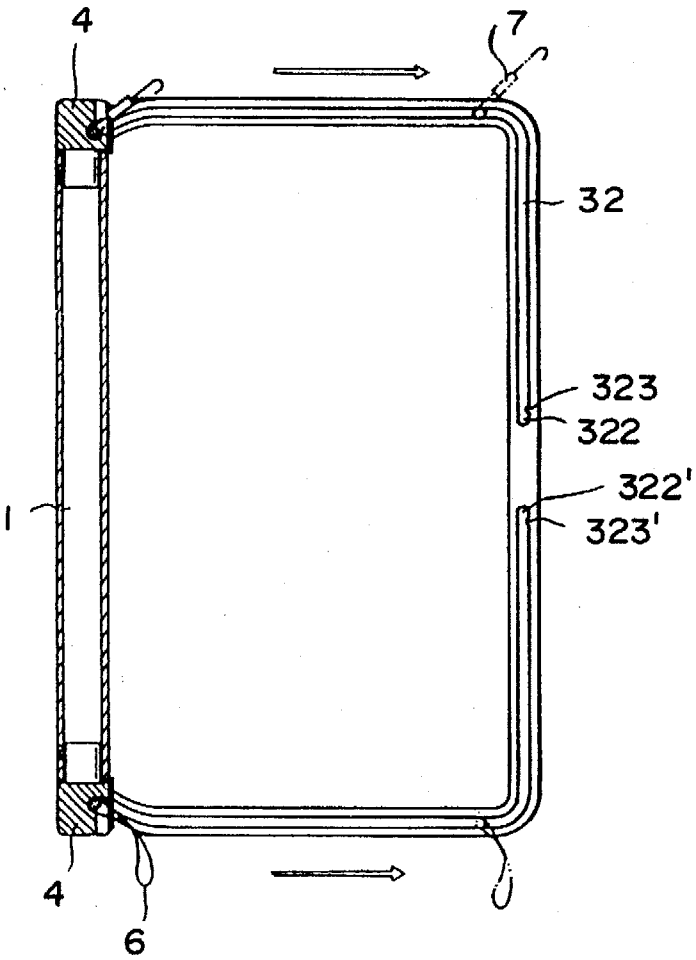

FIG. 5 illustrates the binder of the present invention in a closed and locked state. FIGS. 6-1 and 6-2 illustrate the manner in which the binder of the present invention is locked. As shown in the drawings, when the loose covers 3 are closed relative to each other, the two closing members 5 separately having the pull member 6 and the locking member 7 connected thereto are pulled from the end insertions 4 to the guiding rails 32 around the outer edges of the loose covers 3, such that the slide-guiding ends 51 of the closing members 5 enter into and move along the guiding grooves 321 and 321' extending along the guiding rails 32 until they reach the retaining portions 322 and 322' and are retained thereto. At this point, the locking member 7 is threaded through a hole between the closing mender 5 and the pull member 6, so that the front hook portion 71 of the locking member 7 hooks up the closing member 5 connected to the pull member 6. A lock may be provided to the locking member 7 to lock up the two loose covers 3 together to prevent unauthorized person from using the loose-leaf notebook.

FIG. 7 illustrates the manner in which the locked loose covers 3 are unlocked and opened. As shown in the drawing, the two closing members 5 are pulled backward to the head portions 40 of the end insertions 4 and return to their home positions in the first recesses 402 with the pull member 6 and the locking member 7 lying in the second recesses 401. The loose covers 3 can then be freely opened.

What is claimed is:

1. A binder for loose-leaf notebook, comprising a middle connector, two pivotal connectors, two loose covers, and two end insertions;

said middle connector being a hollow body defining a hollow portion having two end openings for receiving said two end insertions therein, said middle connector further having two side axes projecting from each longitudinal side thereof, forming two clearances between said side axes and said hollow portion;

said pivotal connectors each including a curvy loose cover groove for receiving an inner edge of said loose cover therein and an axis groove behind said curvy loose cover groove for receiving said side axis of said middle connector therein;

said loose covers each having an curvy inner edge for detachably receiving in said loose cover groove of said pivotal connector;

said end insertions each having an insertion portion for inserting into said end opening of said hollow portion of said middle connector and a head portion for stopping said pivotal connector from slipping off and disengaging from said middle connector and said loose cover from said pivotal connector.

2. A binder for loose-leaf notebook as claimed in claim 1, wherein said hollow portion of said middle connector is formed at a ridge portion with a dovetail-shaped label recess, and said end insertions are formed on an outer surface with inward gradually deepened guiding recesses corresponding to said label recess, so that a complete recess for label is formed when said end insertions are inserted into said end openings of said middle connector.

3. A binder for loose-leaf notebook as claimed in claim 1, wherein said label recess is provided with retaining holes and said end insertions are provided with retaining bosses corresponding to said retaining holes, whereby when said end insertions are inserted into said hollow portion of said middle connector, said end insertions are retained in place by the engagement of said retaining bosses with said retaining holes.

4. A binder for loose-leaf notebook as claimed in claim 2, wherein said label recess is provided with retaining holes and said end insertions are provided with retaining bosses corresponding to said retaining holes, whereby when said end insertions are inserted into said hollow portion of said middle connector, said end insertions are retained in place by the engagement of said retaining bosses with said retaining holes.

5. A binder for loose-leaf notebook as claimed in claim 1, wherein said axis grooves of said pivotal connectors each has an outer opening having a width slightly smaller than a diameter of said side axes of said middle connector.

6. A binder for loose-leaf notebook as claimed in claim 1, wherein said loose cover grooves of said pivotal connectors each is a curvy groove contained between an upper and a lower portions of said pivotal connector.

7. A binder for loose-leaf notebook as claimed in claim 1, wherein said curvy inner edge of said loose covers has a lower surface which has a curve corresponding to that of said loose cover groove of said pivotal connector so that said loose covers can be easily slided into said loose cover grooves of said pivotal connectors.

8. A binder for loose-leaf notebook as claimed in claim 1, wherein said loose covers have closing members disposed between them, said closing members each having two slide-guiding ends and being disposed in first recesses formed at inner surfaces of said head portions of said end insertions, wherein said loose covers have guiding rails extending around three outer edges of said loose covers, said guiding rails each having a guiding groove to receive one of said slide-guiding ends of said closing members therein and being provided near their joint with retaining portions, whereby when said loose covers are in an open state said closing members are located in said first recesses of said head portions of said end insertions and when said loose covers are in a closed state said closing members are movable along said guiding rails of said loose covers with said slide-guiding ends located in said guiding grooves of said guiding rails, and said loose covers being locked in a closed state when said closing members are moved into said retaining portions of said guiding rails.

9. A binder for loose-leaf notebook as claimed in claim 8, wherein said closing members have pull members connected thereto to facilitate pulling of said closing members.

10. A binder for loose-leaf notebook as claimed in claim 8, wherein said one of said closing members has a pull member connected thereto and the other one of said closing member has a locking member with front hook means connected thereto, so that said closing members can be held together by engagement of said front hook means with said pull member.

11. A binder for loose-leaf notebook as claimed in claim 10, wherein said guiding rail each has two guiding grooves extending along said guiding rail, retaining parts being provided at two sides of a joint of said two guiding grooves, such that said slide-guiding ends of said closing members can be separately retained in said retaining parts.

12. A binder for loose-leaf notebook as claimed in claim 10, wherein said pull member is an n-shaped member with two projected leg portions forming two loops for one of said closing members to thread through, whereby said front hook means of said locking member can extend through an opening between said pull member and said closing member connected thereto and hook up said closing member.

13. A binder for loose-leaf notebook as claimed in claim 9, wherein said head portion of said end insertion has a second recess axially extending through said inner surface of said head portion and said first recess to receive said pull member therein.

14. A binder for loose-leaf notebook as claimed in claim 10, wherein said head portions of said two end insertions each have a sescond recess axially extending through said inner surfaces of said head portions and said first recesses to receive said pull member in one of said second recesses and said locking member in another one of said second recesses.

* * * * *